United States Patent [19]

Yamaguchi et al.

[11] Patent Number: 5,024,267

[45] Date of Patent: Jun. 18, 1991

[54] COOLING APPARATUS FOR HEAT EXCHANGER

[75] Inventors: Shigeru Yamaguchi, Toyota; Ken-ichiro Mizutani, Kariya, both of Japan

[73] Assignees: Aisin Kako Kabushiki Kaisha, Aichi; Aisin Seiki Kabushiki Kaisha, Kariya, both of Japan

[21] Appl. No.: 537,619

[22] Filed: Jun. 14, 1990

[30] Foreign Application Priority Data

Jun. 28, 1989 [JP] Japan ..... 1-76016[U]

[51] Int. Cl.[5] ..... F28F 13/12; F01P 7/10

[52] U.S. Cl. ..... 165/122; 123/41.49

[58] Field of Search ..... 165/42, 121, 122; 123/41.49

[56] References Cited

U.S. PATENT DOCUMENTS

| | | | |
|---|---|---|---|
| 3,779,341 | 12/1973 | Huggins | 165/122 |
| 3,937,189 | 2/1976 | Beck | 165/122 |
| 4,116,269 | 9/1978 | Ikeda | 123/41.49 |
| 4,213,426 | 7/1980 | Longhouse | 165/122 |
| 4,398,508 | 8/1983 | Moon et al. | 165/121 |
| 4,413,947 | 11/1983 | Seki | 123/41.49 |

FOREIGN PATENT DOCUMENTS 153725 3/1981 Japan .

*Primary Examiner*—John Rivell
*Assistant Examiner*—L. R. Leo
*Attorney, Agent, or Firm*—Oblon, Spivak, McClelland, Maier & Neustadt

[57] ABSTRACT

A cooling apparatus for a heat exchanger includes a shroud having a box-shaped main body covering one of the surfaces of a heat exchanger and a cylindrical portion penetrating through the main body. The axis of the cylindrical portion is substantially perpendicular to the bottom surface of the main body and part of the cylindrical portion is protruded with respect to the outline of the heat exchanger. A fan is disposed in the cylindrical portion of the shroud. The main body includes an enlarged portion disposed adjacent to and corresponding to the protruding part of the cylindrical portion. The bottom surface of the main body extends substantially from the entire periphery of the end portion of the cylindrical portion. The fan protrudes by from 25 to 75% of the lateral width thereof from the bottom surface of the main body to the heat exchanger; whereby an air flow coming from the other surface of the heat exchanger and going out through the cylindrical portion of the shroud by way of the one of the surfaces of the heat exchanger is blown when the fan is driven. Since the shroud is provided with the enlarged portion and since the fan is disposed at the position optimum for reducing the noise, the total static pressure in the shroud is high, and the air flows are blown in the direction parallel to the axis of the cylindrical portion of the shroud. Therefore, less noise is generated by the cooling apparatus.

7 Claims, 3 Drawing Sheets

COOLING APPARATUS FOR HEAT EXCHANGER

BACKGROUND OF THE INVENTION

1. Field of the Invention

The present invention relates to a cooling apparatus for a heat exchanger provided for an automobile radiator and the like.

2. Description of the Prior Art

A shroud is provided for a cooling apparatus of an automobile radiator, and delivers an air flow resulting from a high speed rotation of a fan to the radiator efficiently. For instance, as illustrated in FIGS. 7, 8 and 9, this type of shroud comprises a box-shaped main body 101 covering one of the surfaces of a radiator 300 and a cylindrical portion 102 protruding from the main body 101. Further, a fan 200 is disposed in the cylindrical portion 102. When the fan 200 is driven rotationally, the air in the main body 101 is drawn in by suction, and a negative pressure is generated. The resulting negative pressure creates to an air flow which comes from the other surface of the radiator 300 and goes out through the cylindrical portion 102 by way of the one of the surfaces of the radiator 300.

Recently, noise reduction has been one of the major issues in the automobile industry as a part of a program for improving the habitability in an automobile passenger compartment. In a cooling apparatus for a heat exchanger, noise reduction during the rotation of the fan has been an important issue, and accordingly the configurations of the fan and the shroud have been investigated and researched extensively. Here, the following phenomenon is considered as one of the causes of the noise generation resulting from the shroud. Namely, shock noises are generated when part of the air flows, generated by the action of the fan and having directional vector components being not parallel to the axis of the cylindrical portion, collide with the inner surface of the cylindrical portion. In order to prevent the generation of the shock noises, a shroud having a noise absorbing chamber formed in the inner surface of the cylindrical portion is disclosed, for example, in Japanese Unexamined Utility Model Publication No. 153725/1982.

On the other hand, the following improvements have been carried out recently in order to improve the cooling performance, thereby keeping up with the increasing engine output. Namely, the radiator core has come to be made from a multi-layered structure, and the radiator fins have been provided with a high density and a short pitch, for instance. However, there arises a problem that these improvements have caused increased noise. In addition, the cylindrical portion 102 of the shroud should be disposed at a position deviating from the center of the radiator 300 as illustrated in FIGS. 7, 8 and 9, and part of the cylindrical portion 102 should be made in a configuration protruding with respect to the top of the radiator 300 because of the limitations in designing an automobile body. If such is the case, there also arises a problem of increased noise.

SUMMARY OF THE INVENTION

The present invention has been developed in view of the above-mentioned circumstances. It is therefore a general object of the present invention to reduce the noise even in the above-mentioned circumstances.

We, the inventors of the present invention, have been diligently researched the mechanism of the noise generation due to the action of the fan. As a result of our extensive research, we have found that the noise gets louder when the wind delivery resistance increases in front of the fan. In other words, we have found that the noise gets louder when the total static pressure in the shroud decreases, and that the noise gets lower when the total static pressure in the shroud increases. Further, we have also found that the directions of the air flows depend on the disposing positions of the fan, and that there exists a disposing position of the fan where a maximum number of air flow directional vector components being parallel to the axis of the cylindrical portion is provided in the air flow. The present invention has been developed in accordance with these discoveries.

The above and other purposes of the present invention have been achieved by the present invention and the aforementioned discoveries have been embodied in a cooling apparatus for a heat exchanger according to the present invention comprising: a shroud comprising a box-shaped main body disposed in a manner covering one of the surfaces of a heat exchanger; and a cylindrical portion disposed in a manner penetrating through the main body; wherein the axis of the cylindrical portion is disposed substantially perpendicular to the bottom surface of the main body and part of the cylindrical portion is protruded with respect to the outline of the heat exchanger; and a fan disposed in the cylindrical portion of the shroud; wherein the main body comprises an enlarged portion disposed adjacent to and corresponding to the protruding part of the cylindrical portion; the bottom surface of the main body extends substantially from the entire periphery of the end portion of the cylindrical portion; and the fan is disposed in a manner protruding by from 25 to 75% of the lateral width thereof from the bottom surface of the main body to the heat exchanger; whereby an air flow coming from the other surface of the heat exchanger and going out through the cylindrical portion of the shroud by way of the one of the surfaces of the heat exchanger is blown when the fan is driven rotationally.

The cooling apparatus for a heat exchanger according to the present invention comprises the shroud and the fan. The shroud comprises the box-shaped main body and the cylindrical portion. As for the fan, a conventional fan may be employed.

One of the major features of the present invention is that the main body of the shroud comprises the enlarged portion disposed adjacent to and corresponding to the protruding part of the cylindrical portion of the shroud, and that the bottom surface of the main body extends substantially from the entire periphery of the end portion of the cylindrical portion. That is to say, most of the whole cylindrical portion protrudes virtually from the bottom portion of the main body. It is preferable to have the enlarged portion swollen greater than the protruding part of the cylindrical portion. In this manner, the entire periphery of the cylindrical portion is surrounded by the bottom portion of the main body, thereby enabling to further reduce the noise.

The other major feature of the present invention is that the fan is disposed in a manner protruding by from 25 to 75% of the lateral width thereof from the bottom surface of the main body to the heat exchanger. The cooling apparatus according to the present invention has these two (2) major features at the same time, and accordingly the latter major feature is satisfied virtually around the entire periphery of the cylindrical portion.

To put it differently, the fan cannot be disposed in the above-mentioned protruding manner around the entire periphery portion of the cylindrical portion when the shroud does not have the swollen portion as in the case of the conventional cooling apparatus. Here, the lateral width of the fan shall mean the width of the blade portion of the fan when the fan is viewed in a projection drawing projected in the lateral direction thereof. When the protrusion amount of the fan does not fall in the above-mentioned range, it is hard to reduce the noise.

The inventors of the present invention observed the directions of the air flows in the following manner: First, a fan was installed to an airflow testing machine, and the airflow testing machine was operated to measure the air capacity and the total static pressure in front of the fan while varying the wind delivery resistance in front of the fan over a wide variety of range. At the same time, the directions of the air flows generated by the fan were also observed. As a result, the total static pressure is small when the wind delivery resistance in front of the fan is large. In this case, the air capacity is accordingly small and the air flows exhibit an inclining flow tendency, i.e., the air flows spread in predetermined angles with respect to the axial direction of the fan. On the contrary, the total static pressure is large when the wind delivery resistance in front of the fan is small. If such is the case, the air capacity is accordingly large and the air flows exhibit an axial flow tendency being parallel to the axial direction of the fan. It is preferable to make the air flows parallel to the axis of the cylindrical portion in order to reduce the noise. Therefore, it is preferable to make the total static pressure higher in front of the fan in the shroud.

In the conventional cooling apparatus, only the part of the cylindrical portion of the shroud is protruded as illustrated in FIGS. 7, 8 and 9. Consequently, the air flows get complicated in the conventional cooling apparatus, the total static pressure in the shroud gets lower, and the air flows in the cylindrical portion tend to exhibit the flow tendency inclining with respect to the axis of the cylindrical portion, whereby the noise is made louder. On the contrary, in the cooling apparatus according to the present invention, not only the part of the cylindrical portion of the shroud is protruded but also the part of the main body of the shroud is enlarged with respect to the outline of the heat exchanger. Therefore, the bottom portion of the shroud extends substantially from the entire periphery of the cylindrical portion. Accordingly, the volume of the shroud is increased, and the shroud gives less resistance to the air flows. As a result, the total static pressure in the shroud gets higher, and the air flows in the cylindrical portion tend t exhibit the flow tendency being parallel to the axis of the cylindrical portion, thereby reduce the noise.

In addition, the inventors of the present invention prepared and arranged a shroud 1, a fan 2 and a radiator 3 in a manner as illustrated in FIG. 5, and measured the noise level (sound pressure level) while extensively varying a dimension "B" of the fan 2 protruding from the inner bottom surface 10*d* of the shroud 1. Here, the fan 2 was fixed at a fixed position, and the configuration of the shroud 1 was varied in order to vary the dimension "B." Then, the fan 2 was rotated at an identical and predetermined number of revolutions per minute. Further, the dimension "A," i.e., the lateral width of the blade portion of the fan 2 was set to be 80 mm, and the shroud 1, the fan 2 and the radiator 3 were disposed so that the dimension "L" designated in FIG. 5 was set to be 65 mm. The result of this measurement is illustrated in FIG. 6.

As can be seen from FIG. 6, the noise level fluctuates and depends on the dimension "B." It was found that the sound pressure level becomes preferable when the dimension "B" falls in the range of from 25 to 75% of the dimension "A," namely from 25 to 75% of the lateral width of the blade portion of the fan 2. This phenomenon is believed to result from the following: When the dimension "B" is less than 25% of the dimension "A," the inner wall of the shroud 1 gives more resistance to the air flows, the total static pressure in the shroud 1 decreases, and the air flows in the cylindrical portion 11 tend to exhibit the flow tendency inclining with respect to the axis of the cylindrical portion 11, whereby the noise gets louder. On the other hand, when the dimension "B" is more than 75% of the dimension "A," the air flows in the cylindrical portion 11 are disturbed, and the vortex flows increase, whereby the noise gets louder.

Namely, the dimension "B" is less than zero (0) at the protruding portion of the cylindrical portion in the conventional cooling apparatus as illustrated in FIG. 9, and the noise is extremely loud as can be seen from FIG. 6. On the contrary, the noise has been reduced sharply, because the dimension "B" is provided substantially all around the entire periphery of the cylindrical portion in the cooling apparatus according to the present invention, and because the dimension "B" is set in the range in which the noise gets lower.

According to the cooling apparatus of the present invention, the air flows in the shroud are made smooth, and the air flows come to comprise a large number of directional vector components being parallel to the axis of the cylindrical portion of the shroud even when the cylindrical portion of the shroud has the following configuration, i.e., the part of the cylindrical portion is protruded with respect to the outline of the heat exchanger. Moreover, the effect of the noise reduction is further enhanced, because the dimension "B" is set in the range optimum for reducing the noise as aforementioned.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS OF THE INVENTION

Having generally described the present invention, a further understanding can be obtained by reference to certain specific preferred embodiments which are provided herein for purposes of illustration only and are not intended to be limiting unless otherwise specified. The preferred embodiments of the cooling apparatus according to the present invention will be hereinafter described with reference to the drawings.

First Preferred Embodiment

Figure 1:
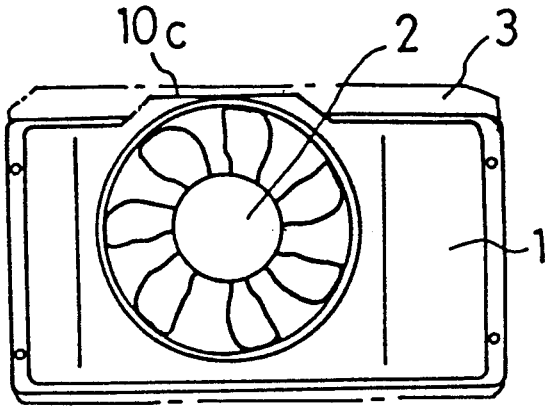
FIG. 1 is a front view of the first preferred embodiment thereof.
Figure 2:
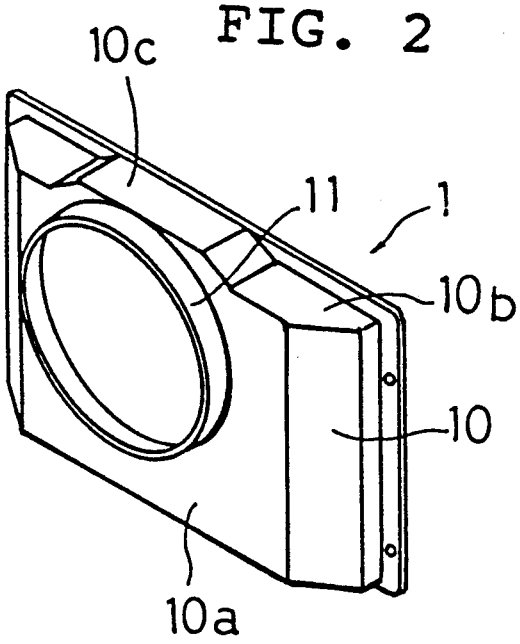
FIG. 2 is a perspective view of a shroud of the first preferred embodiment thereof.

The front view of the first preferred embodiment of the cooling apparatus according to the present invention is shown in FIG. 1, and the perspective view of the shroud thereof is shown in FIG. 2. This cooling apparatus comprises a shroud 1 comprising a box-shaped main body 10 and a cylindrical portion 11 protruding from the main body 10, and a fan 2 disposed in the cylindrical portion 11 of the shroud 1. A radiator 3 of a rectangular shape is fixed on one of the surfaces of the shroud 1.

The cylindrical portion 11 is protruded from the bottom surface 10*a* of the main body 10, and an upper part of the cylindrical portion 11 is protruded with respect to the top side of the rectangle defined by the radiator 3 because of the limitations in providing the whole cooling apparatus in an automobile engine compartment. Further, an enlarged portion 10*c* of a trapezoid shape in cross section is formed on a side surface 10*b* of the main body 10 corresponding to the protruding part of the cylindrical portion 11. Furthermore, the top portion of the protruding part of the cylindrical portion 11 and the top portion of the enlarged portion 10*c* are in the same plane. Hence, the bottom surface 10*a* of the main body 10 extends from the entire periphery of the cylindrical portion 11 except at the top portion of the cylindrical portion 11.

In addition, the fan 3 has a plurality of blade portions whose lateral width, i.e., the above-mentioned dimension "A," is 80 mm. The fan 3 is so disposed that the above-mentioned dimensions "B" and "L" are 40 mm and 65 mm respectively.

Second Preferred Embodiment

Figure 3:
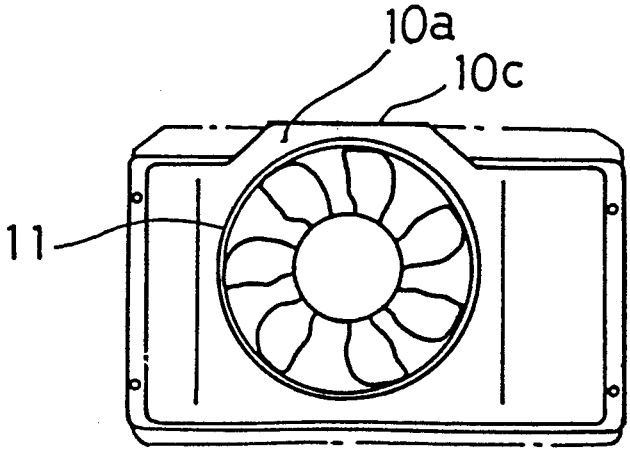
FIG. 3 is a front view of a second preferred embodiment of a cooling apparatus according to the present invention.

The front view of the second preferred embodiment of the cooling apparatus according to the present invention is shown in FIG. 3. In this second preferred embodiment, the enlarged height of the swollen portion 10*c* is made higher than that of the first preferred embodiment. Other than this arrangement, the second preferred embodiment has identical arrangements with those of the first preferred embodiment. To be specific, the distance between the top portion of the enlarged portion 10*c* and the top portion of the cylindrical portion 11 is 20 mm, and the bottom surface 10*a* is also formed between the enlarged portion 10*c* and the cylindrical portion 11.

Performance Evaluation Test

Figure 4:
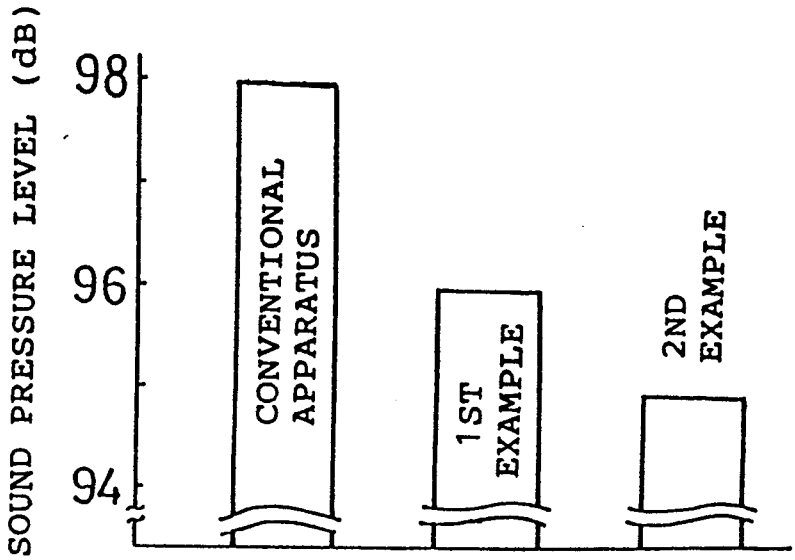
FIG. 4 is a column chart showing the sound pressure levels exhibited when the cooling apparatuses of the first and second preferred embodiment and a conventional cooling apparatus are operated.
Figure 6:
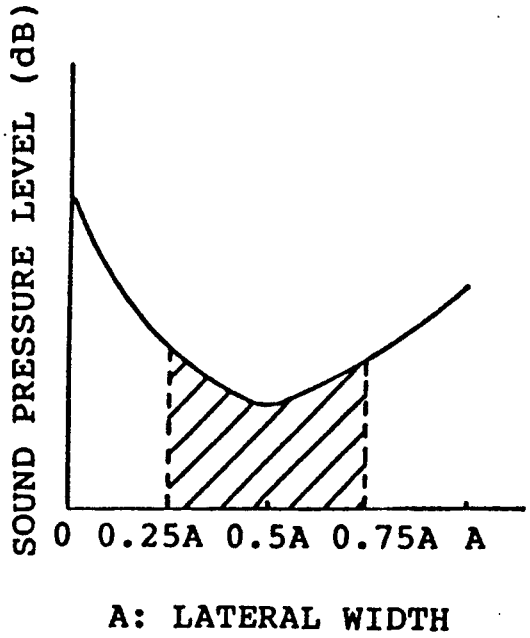
FIG. 6 is a line chart showing the relationship between the dimension "B" and the sound pressure level.
Figure 5:
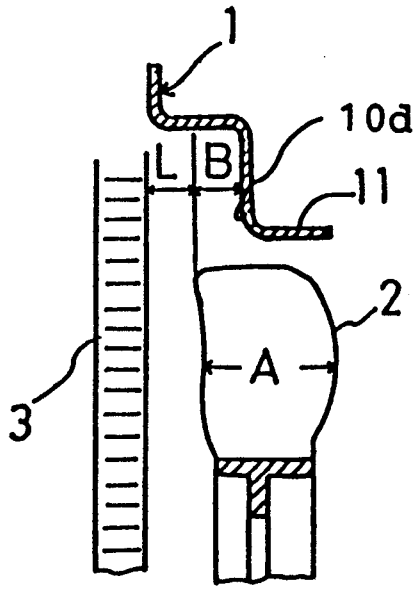
FIG. 5 is an explanatory cross sectional view illustrating the dimension "B"
Figure 7:
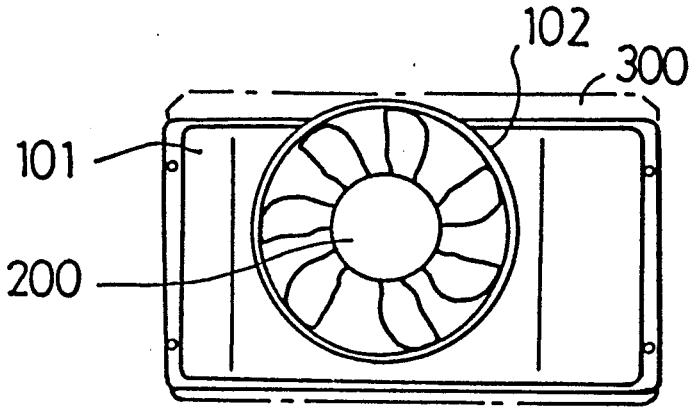
FIG. 7 (Prior Art)
FIG. 7 is a front view of the conventional cooling apparatus.
Figure 8:
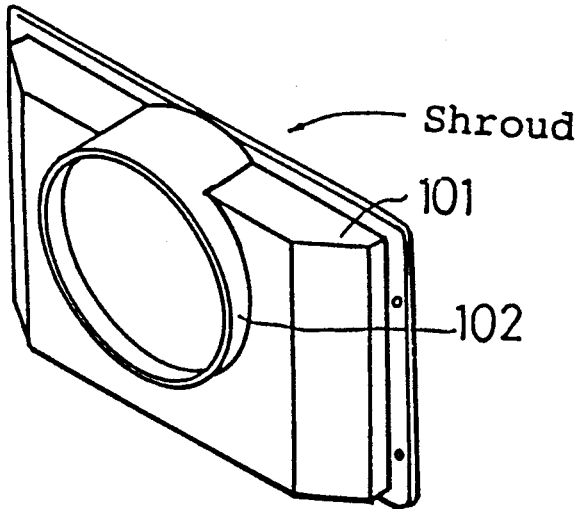
FIG. 8 (Prior Art)
FIG. 8 is a perspective view of a shroud of the conventional cooling apparatus.
Figure 9:
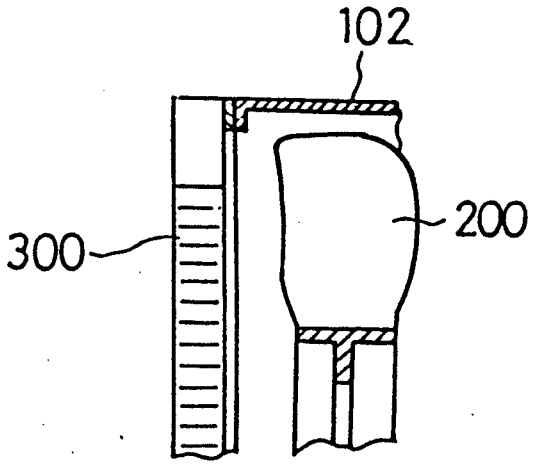
FIG. 9 (Prior Art)
FIG. 9 is a cross sectional view of a major portion of the conventional cooling apparatus.

The first and second preferred embodiments of the cooling apparatus were respectively operated under the identical operation condition of the air capacity passing through the radiator 3 at the rate of 1.5 $m^3$/sec. Then, the sound pressure level was measured at the position in the back of the fan 2 by 30 cm. The results of the measurement are shown in FIG. 4. In order to compare the noise reduction performances of the first and second preferred embodiments with that of the conventional cooling apparatus as illustrated in FIGS. 7, 8 and 9, the conventional cooling apparatus was operated, and its sound pressure level was measured similarly. The conventional cooling apparatus had identical arrangements with those of the first and second preferred embodiment except that it did not have the enlarged portion 10*c*.

It is apparent from FIG. 4 that the noise was reduced more in the first and second preferred embodiment of the cooling apparatus according to the present invention than in the conventional cooling apparatus. Additionally, the noise was reduced more in the second preferred embodiment of the cooling apparatus than in the first preferred embodiment thereof. It is apparent from these results that the noise reduction results from the employment of the enlarged portions 10*c* and the selection of the dimension "B."

Having now fully described the present invention, it will be apparent to one of ordinary skill in the art that many changes and modifications can be made thereto without departing from the spirit or scope of the present invention as set forth herein.

What is claimed is:

1. A cooling apparatus for a heat exchanger comprising:

a shroud comprising a box-shaped main body disposed so as to cover one of the surfaces of a heat exchanger, and a cylindrical portion disposed in a manner penetrating through said main body, wherein the axis of said cylindrical portion is disposed substantially perpendicular to the bottom surface of said main body and part of said cylindrical portion is protruded with respect to the outline of said heat exchanger; and a fan disposed in said cylindrical portion of said shroud;

wherein said main body comprises an enlarged portion disposed adjacent to and corresponding to said protruding part of said cylindrical portion;

said bottom surface of said main body extends substantially from the entire periphery of the end portion of said cylindrical portion; and said fan is disposed in a manner protruding by from 25 to 75% of the lateral width thereof from said bottom surface of said main body to said heat exchanger;

whereby an air flow coming from the other surface of said heat exchanger and going out through said cylindrical portion of said shroud by way of said one of the surfaces of said heat exchanger is blown when said fan is driven rotationally, wherein the top of said enlarged portion is at least flush with the top of said protruding part of said cylindrical portion.

2. The cooling apparatus for a heat exchanger according to claim 1, wherein said enlarged portion is enlarged by an amount greater than said protruding part of said cylindrical portion.

3. A cooling apparatus for a heat exchanger comprising:

a shroud comprising a box-shaped main body disposed in a manner covering one of the surfaces of a heat exchanger, and a cylindrical portion disposed in a manner penetrating through said main body, wherein the axis of said cylindrical portion is disposed substantially perpendicular to the bottom surface of said main body and part of said cylindrical portion is protruded with respect to the outline of said heat exchanger; and a fan disposed in said cylindrical portion of said shroud;

wherein said main body comprises an enlarged portion disposed adjacent to and corresponding to said protruding part of said cylindrical portion, and said bottom surface of said main body extends substantially from the entire periphery of the end portion of said cylindrical portion, wherein the top of said enlarged portion is at least flush with the top of said protruding part of said cylindrical portion.

4. The cooling apparatus for a heat exchanger according to claim 3, wherein said fan is disposed in a manner protruding by from 25 to 75% of the lateral width thereof from said bottom surface of said main body to said heat exchanger.

5. The cooling apparatus for a heat exchanger according to claim 3, wherein said enlarged portion is enlarged greater than said protruding part of said cylindrical portion.

6. A cooling apparatus for a heat exchanger comprising:

a shroud comprising a box-shaped main body disposed so as to cover one of the surfaces of a heat exchanger, and a cylindrical portion disposed in a manner penetrating through said main body, wherein the axis of said cylindrical portion is disposed substantially perpendicular to the bottom surface of said main body and part of said cylindrical portion is protruded with respect to the outline of said heat exchanger; and a fan disposed in said cylindrical portion of said shroud;

wherein said main body comprises an enlarged portion disposed adjacent to and corresponding to said protruding part of said cylindrical portion;

said bottom surface of said main body extends substantially from the entire periphery of the end portion of said cylindrical portion; and said fan is disposed in a manner protruding by from 25 to 75% of the lateral width thereof from said bottom surface of said main body to said heat exchanger;

whereby an air flow coming from the other surface of said heat exchanger and going out through said cylindrical portion of said shroud by way of said one of the surfaces of said heat exchanger is blown when said fan is driven rotationally, wherein said enlarged portion has a trapezoid shape cross section taken perpendicularly to the axis of said cylindrical portion.

7. A cooling apparatus for a heat exchanger comprising:

a shroud comprising a box-shaped main body disposed in a manner covering one of the surfaces of a heat exchanger, and a cylindrical portion disposed in a manner penetrating through said main body, wherein the axis of said cylindrical portion is disposed substantially perpendicular to the bottom surface of said main body and part of said cylindrical portion is protruded with respect to the outline of said heat exchanger; and a fan disposed in said cylindrical portion of said shroud;

wherein said main body comprises an enlarged portion disposed adjacent to and corresponding to said protruding part of said cylindrical portion, and said bottom surface of said main body extends substantially from the entire periphery of the end portion of said cylindrical portion, wherein said enlarged portion has a trapezoid shape cross section taken perpendicularly to the axis of said cylindrical portion.

* * * * *